United States Patent [19]

Torgow

[11] Patent Number: 4,754,980

[45] Date of Patent: Jul. 5, 1988

[54] GAME APPARATUS UTILIZING A BALL CONTROLLED ELECTRICAL SWITCH

[76] Inventor: Abraham Torgow, 25 Concord Cir., Howell, N.J. 07731

[21] Appl. No.: 860,238

[22] Filed: May 6, 1986

Related U.S. Application Data

[63] Continuation-in-part of Ser. No. 621,513, Jun. 18, 1984, Pat. No. 4,595,202, which is a continuation-in-part of Ser. No. 222,667, Jan. 2, 1981, Pat. No. 4,477,078, which is a continuation-in-part of Ser. No. 23,730, Mar. 26, 1979, Pat. No. 4,264,073.

[51] Int. Cl.[4] ..... A63F 5/00; A63F 7/32; A63F 9/02; G09B 19/02

[52] U.S. Cl. ..... 273/356; 200/61.11; 273/141 A; 273/142 E; 273/142 HA; 273/145 C; 273/357; 273/375; 273/377; 273/399; 434/209

[58] Field of Search ..... 273/118 A, 119 A, 120 R, 273/120 A, 121 A, 122 A, 123 R, 123 A, 124 A, 125 A, 141 A, 142 E, 142 F, 142 HA, 145 C, 355, 356, 357, 405, 399, 375, 377; 200/61.11; 434/198, 209

[56] References Cited

U.S. PATENT DOCUMENTS

| | | | |
|---|---|---|---|
| 970,321 | 9/1910 | Gallagher | 273/123 R X |
| 1,094,559 | 4/1914 | Harrison | 273/123 R X |
| 1,148,944 | 8/1915 | Albrecht | 273/355 |
| 1,619,849 | 3/1927 | Brittingham | 434/209 X |
| 2,065,424 | 12/1936 | Brubaker | 434/198 |
| 2,370,229 | 2/1945 | Buckley | 273/142 HA |
| 2,667,354 | 1/1954 | Mathews et al. | 273/141 A |
| 2,769,640 | 11/1956 | Elder | 434/209 X |
| 2,871,581 | 2/1959 | Guzak | 434/209 X |
| 3,545,101 | 12/1970 | Fike | 273/271 X |
| 3,705,727 | 12/1972 | Breslow | 273/271 |
| 3,901,511 | 8/1975 | Garbark | 273/119 A |
| 4,130,280 | 12/1978 | Lowell | 273/122 A |

FOREIGN PATENT DOCUMENTS

| | | | |
|---|---|---|---|
| 2063077 | 6/1981 | United Kingdom | 273/121 A |

*Primary Examiner*—Anton O. Oechsle

[57] ABSTRACT

A game apparatus consisting of a housing, the interior of the housing has electrical wiring and a power switch including a switching means, for starting and stopping a toy motor. The motor being coupled to spin a multi-disk assembly. The disks are divided into sectors and each sector as a symbol marking printed thereon. When the switching means causes the motor to spin, the disks free-spin around the motor shaft. When the switching means disconnect the motor from the electrical power source, the disks coast to a stop. An indicating means designates two random symbols in alignment.

The random symbol generator in conjunction with a multiplication type game board is used as a "non-problem solving" educational game.

In an another embodiment, the random symbol generator is used in conjunction with a marble operated switching means, wherein a marble is aimed at a target opening, its entrance into the target opening closes the switching means, thereby causing the multi-disk symbol generator to spin. The exiting of the marble opens the switching means, the multi-disks coast to a stop, designating two symbols in alignment with an indice means, this embodiment being the nucleus of a unique marble aiming skill strategy game.

40 Claims, 6 Drawing Sheets

GAME APPARATUS UTILIZING A BALL CONTROLLED ELECTRICAL SWITCH

This application is a continuation-in-part of my copending application, Ser. No. 06/621,513, filing date June, 18, 1984, now U.S. Pat. No. 4,595,202, which in turn is a continuation of application Ser. No. 222,667, filed Jan. 2, 1981, now U.S. Pat. No. 4,477,078 granted Oct. 16, 1984, which in turn is a continuation of application Ser. No. 023,730, filed Mar. 26, 1979, now U.S. Pat. No. 4,264,073 granted on Apr. 28, 1981.

The invention consists of a game apparatus utilizing a new type random symbol generator, which in conjunction with:

(a) A multiplication table type axes coordinate game board is the nucleus of unique "non-problem solving" mathematical education games.

(b) A new type of a ball controlled electrical switch is the nucleus of unique skill action marble aiming games.

REFERENCES CITED

U.S. PATENT DOCUMENTS

| | | |
|---|---|---|
| 2,004,190 6/1935 Breitenstein | 273/121 | A |
| 2,152,598 3/1939 Mills | 273/118 | A |
| 2,283,583 5/1942 Singer | 273/142 | HA |
| 2,370,229 2/1945 Buckley | 273/142 | HA |
| 3,870,307 3/1975 Meyer et al. | 273/121 | A |
| 3,975,019 8/1976 Barlow | 273/121 | A |

FOREIGN PATENT DOCUMENTS

| | | |
|---|---|---|
| 2492 of 1926 Australia | 273/123 | A |
| 17354 10/1980 European Pat. Off. | 273/142 | HA |
| 629641 2/1960 Italy | 273/125 | A |

BACKGROUND OF THE INVENTION

In my prior applications, a marble-sized ball is aimed at a target opening. If the ball enters the opening, it drops onto a ball support member, and thereby energizes an electrical toy motor. The toy motor drives multiple disks. The disks are divided into sectors, each sector having its own designation. The motor stops spinning, when the ball rolls off the ball support. The disks stop spinning in a random alignment with each other.

U.S. Pat. No. 4,264,073 describes the completion of the circuit to the motor by means of a metal ball rolling down and off two conducting rails, that are part of the ball support. Once the ball rolls off the rails, the circuit is broken and the motor and disks coast to a stop.

U.S. Pat. No. 4,477,978 describes the completion of the circuit by means of a glass marble, rolling down and off a plastic resilient ball support member. The weight of this marble on the support causes the support to move downward. An electrical contact mounted on the underside of the ball support, makes an electrical connection to a metal plate beneath it, thereby closing the circuit to the motor. Once the ball rolls off the ball support, the support returns to its unweighted position. The electrical contacts open, and the motor and the disk's rotation coasts to a stop. In both of the cited methods of completing the electrical circuit to the motor, the motor activation time is dependent on the time it takes for the ball to roll down and off the ball support. In certain instances, the ball will roll so rapidly that the motor does not get a chance to reach a useful speed; in other instances the ball will fail to roll down the support, thereby causing the motor to stay on indefinitely.

In this case, it is necessary for the player to tilt the game apparatus, so as to cause the ball to roll off the support.

PROBLEMS WITH THE PREVIOUS INVENTION DISK ASSEMBLY

The assembly consists of a lower disk, a middle disk, and a top pointer disk. The lower and the pointer disks rotate around the motor shaft but are not attached to the shaft. The middle disk is attached to the shaft and rotates with the shaft. The middle disk and the pointer disk receive their rotational force from a slipping sliding frictional contact with the middle disk.

The middle and bottom disks are divided in value sectors, when the disks stop spinning, the sectors stop in random alignment with the pointer. The clearance between the disks is critical. If the space between the disks is too tight, the disks will spin together and stay in alignment; if the spacing is too loose, the free-wheeling disks will not rotate at all.

In addition to the problem of making an assembly requiring precision assembly, the physical contact between the disks tend to throw the adjustment out, after extended usage. It became apparent that a better ball support and disk assembly mechanism was needed, if the game was to be commercially mass produced.

BALL SUPPORT IMPROVEMENT OBJECTIVE

In the present invention, the ball is stopped on the ball support until the motor speed reaches specifications. Once the motor comes up to speed, this motor rotation causes the ball to be dislodged from the ball support. This method differs from the previous invention operation, in that the motor must come up to a useful speed before the motor electrical circuit is broken.

The invention objective is to achieve a high speed motor-disk rotation, but one whose spin time is not overly long, in that if the player must wait an excessive time for the disks to stop spinning before continuing the game, it slows down the game action. A good overall spin time is approximately twenty seconds to accomplish this objective. A method of preventing the ball from leaving the ball support until the motor speed came up to design specification, and a method of dislodging the ball at this speed had to be invented.

DISK ASSEMBLY IMPROVEMENT OBJECTIVE

The objectives of the new disk assembly design is to create a disk assembly that does not require any adjustment in construction, one that will function indefinitely without mechanical problems.

The present invention disk assembly accomplishes the above objectives. It is also a more efficient device, in that it requires less motor spin time to come up to speed.

RANDOM DISK ASSEMBLY IMPROVEMENT

In the present invention, all the disks are free wheeling. They receive their rotational energy by resting on the surfaces of a stepped cylinder collar. The collar is force-fitted onto the motor shaft and rotates with the shaft.

The disks fit over the collar, so that each disk rests on its own collar surface. In this embodiment, no adjustments are made. The disks simply rest on the collar surface and randomly spin in relationship to each other.

One embodiment described uses the vibrational force generated by the motor and disk rotation to dislodge the ball from the ball support. An alternate embodiment makes use of an air flow force generated by the rotation. However, there are other ways to accomplish the channeling of the forces generated by the motor disk rotation. For example, the centrifugal forces generated by the rotation can be used to trip a gate, thereby releasing the ball off the ball support Whatever approach is used the basic concept is that the ball is contained on the support until it is dislodged as a result of the motor reaching a useful speed.

The present invention also describes an improved game apparatus in aspects not included in the previous invention. The previous invention describes an apparatus having one player position. When the player's turn at the apparatus changed, the first player would have to move to allow the new player access to the apparatus. In the present invention, there are two playing positions on opposite sides of the apparatus, thereby enabling two players to maintain their positions during the game play.

The previous invention described an apparatus that had only one target opening that caused the motor circuit to be activated. The present invention describes an apparatus with multiple target openings; having multiple target openings enables a game play in which there is an interaction between the disk readout and the target opening (i.e., a disk readout can specify a designated target opening, which, if made, will in turn reactivate the disks so as to obtain a new target opening designation). The addition of multiple openings to the apparatus improves the continuity of the game play and broadens the options of game design available to the game maker.

The concept of having the motor speed being the controlling factor in determining the motor activation time, allows other random symbol generator assemblies to be used; a roulette wheel or a dice tumbler, which requires a longer energizing period to function that the multi-disk assembly can be utilized.

SUMMARY OF THE INVENTION

In its broadest aspect, the game apparatus of the invention comprises of:

(i) A housing having a top playing surface, said playing surface being generally rectangular in shape, said surface having a player's position at each far end, said surface having two sets of openings, each set being associated with a playing position, said openings being dimensioned to allow passage of a ball into the interior of said housing. Each playing position being equipped with an aimable ball propelling means.

(ii) An elongated support means positioned below said playing surface to receive a ball which has passed through said opening.

(iii) A rotor, coupled for activation by an electric powered device.

(iv) A source of electrical current.

(v) An electrical wiring connecting said current source, said support means being adapted upon receiving said ball to complete a current feed circuit to said powered device, and to maintain said current feed circuit for a period of time, said time period being a function of force generated by the activation of said electrical powered device, said force acting to dislodge said ball from said ball support.

In a first embodiment, said support means includes an elongated resilient bendable strip mounted to said housing and having a portion resiliently movable with respect to said housing, said movable portion carrying one of a pair of cooperating contacts arranged in said current feed circuit, said movable portion of said strip having an unconstrained rest condition in which said contracts are open, said movable portion of said strip being adapted upon receiving said ball to be moved to a constrained position of resilient deformation, in which said contacts are closed, and after said ball has been dislodged from said support, to be restored to said rest position, said support means being adapted to contain said ball on said support, said activation of said powered device, in conjunction with said rotor rotation, causing structural vibration in sais support strip and against said ball, to cause said ball to pass off said support, thereby disconnecting said electric powered device from said current source.

In a second embodiment, said included support means includes a pair of spaced adjacent elongated electrical conductors, adapted to be bridged electrically by an electronically conductive ball, said support means being adapted to contain said ball on said support, said activation of said powered device, in conjunction with said rotor rotation, causing an air flow force, said force acting against said ball, to cause said ball to pass off said support, thereby disconnecting said electric powered device from said current source.

In a third embodiment, the random symbol generator is used in conjunction with a multiplication type coordinate game board.

These and other features, objectives and advantages of the invention will be apparent in the following description taken in conjunction with the accompanying drawings.

DESCRIPTION OF THE FIRST EMBODIMENT

Figures 1, 3, 4, 5:
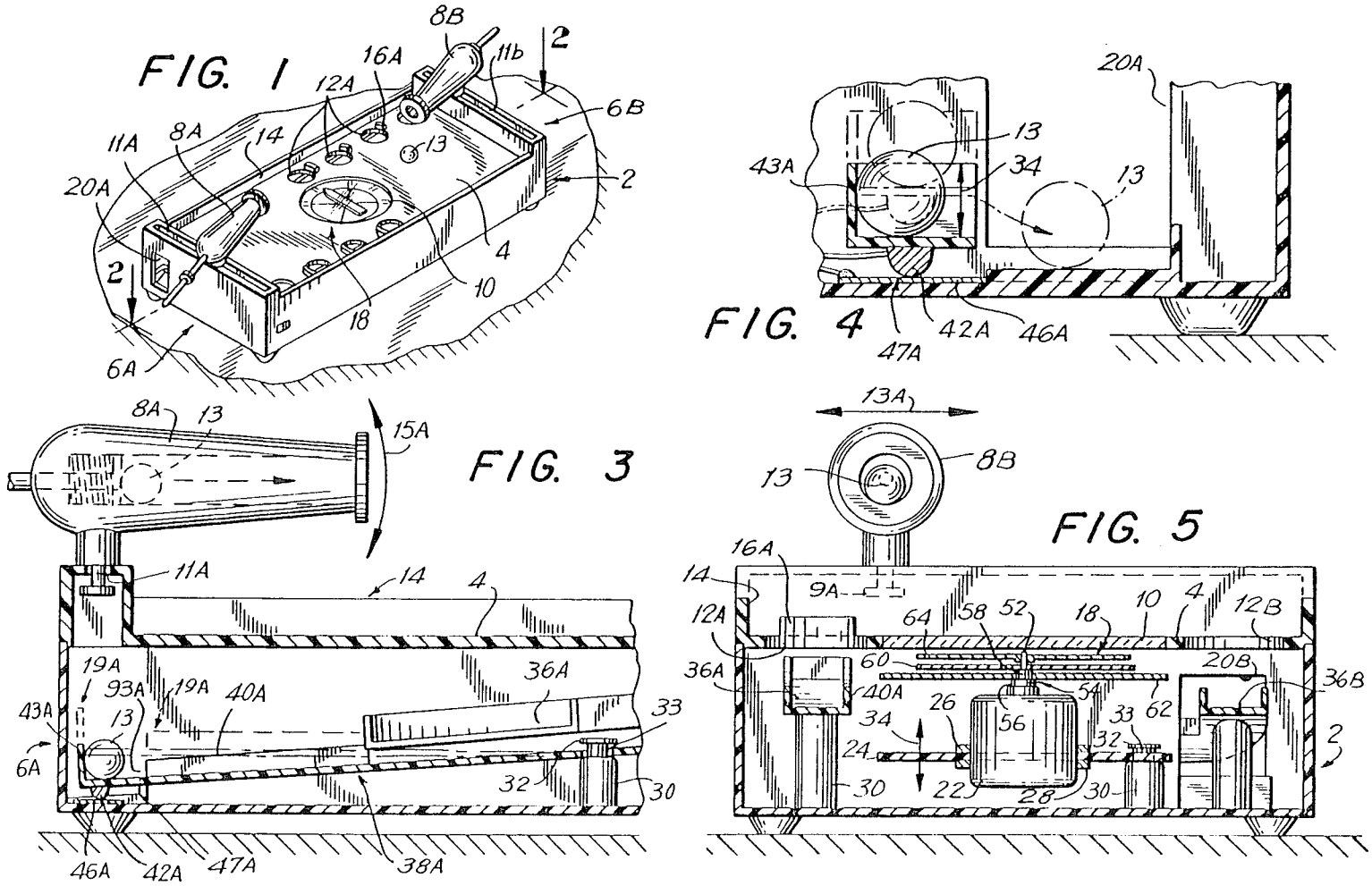
FIG. 1 is a perspective view of a game.
FIG. 3 is a partial cross-sectional view taken generally along the lines 3—3 of FIG. 2.
FIG. 4 is a partial cross-sectional view taken generally along the lines 4—4 of FIG. 2.
FIG. 5 is a partial cross-sectional view taken generally along the lines 5—5 of FIG. 2.

As shown in FIG. 1, in an elongated generally rectangular shaped housing assembly 2, the top surface 4 is the game's playing surface. The game has two playing positions 6A–6B on opposite ends of the game surface 4.

The game apparatus can be considered to consist of two sets of congruent parts, one set being associated with one player's position 6A and the other with the other player's position 6B. All designation of the parts of the apparatus in the drawings that apply to one playing position or the other are subscribed with the letter "A" or "B." All parts that are common to both players' positions have only a number designation. In general, the description describing the operation of the invention is as seen from playing position 6A. Any reference to a part with the "A" subscript also refers to the complementary "B" subscripted part. A description of the operation of the game as seen from playing position 6B is identical. An aimable marble propelling cannon 8A is mounted at playing position 6A.

As shown in FIG. 3 and FIG. 5, the cannon 8A mounting mechanism 9A rides in slot llA and is free to swivel horizontally as shown in FIG. 5 movement arrow 13A and to elevate, as shown in FIG. 3, movement arrow 15A.

Figure 2:
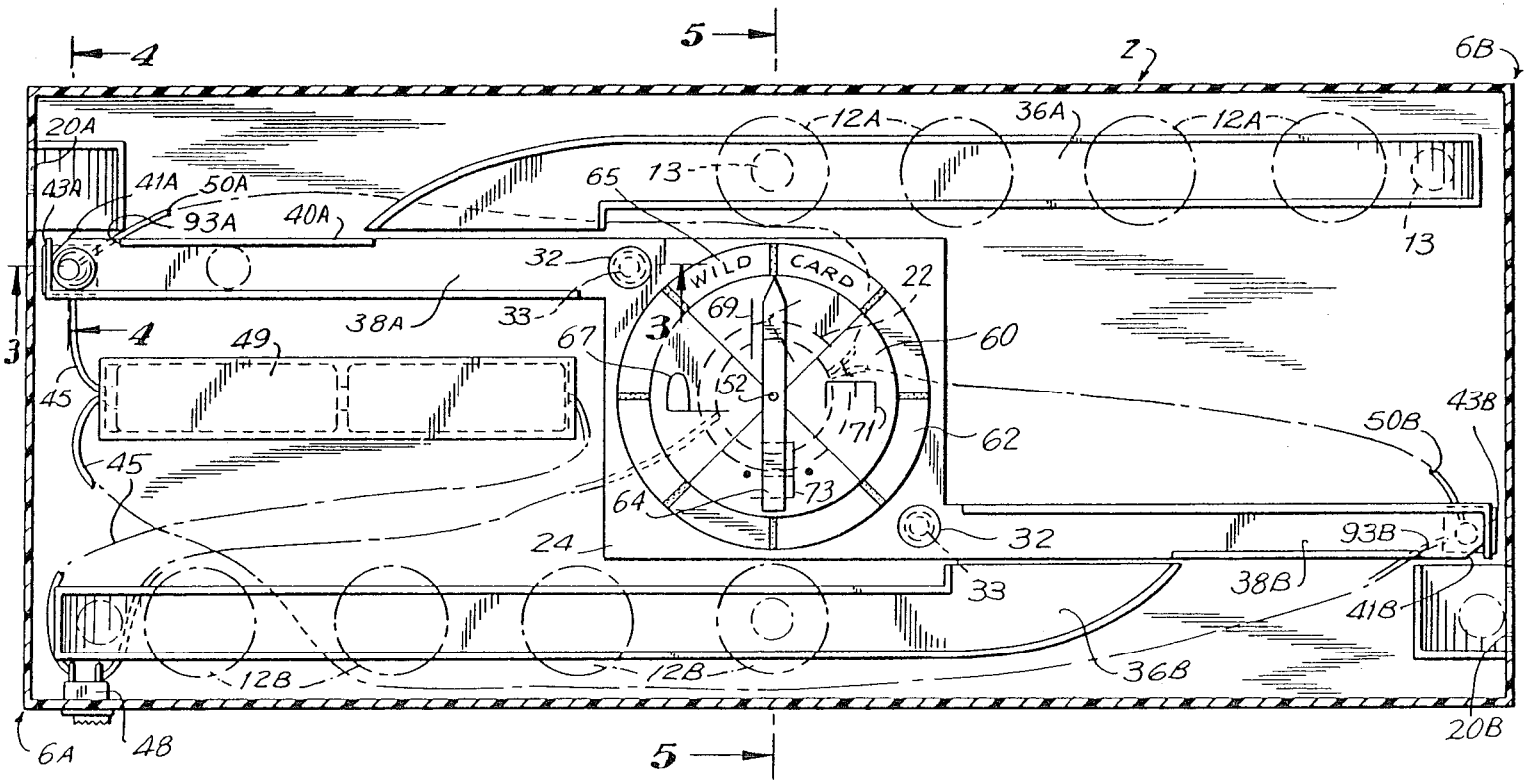
FIG. 2 is a horizontal cross-sectional view taken generally along the lines 2—2 of FIG. 1.

As shown in FIG. 1 and FIG. 2, the game surface 4 has a circular transparent window 10 centrally located on the playing surface 4. A set of openings 12A allow entry of a marble sized ball 13 into the interior of the housing 2. A ball retaining wall 14 projecting above the surface 4 and around the periphery keeps the ball from going over the edges of the playing surface 4. Each opening 12A has a ball bounce back upright 16A to make it easier for the player to place the ball into the opening 12A. A multi-disk assembly 18 is located beneath the transparent window 10. The ball 13 entering an opening 12A, causes the multi-disk assembly 18 to spin. The ball 13 exits out of the housing 2 at the shooter's position 6A from the ball exit opening 20A. The multi-disk assembly 18 stops spinning in random alignment with a pointer 64, which is part of the multi-disk assembly 18.

FIG. 5 indicates that the interior of the housing 2 is equipped with a DC motor 22, as can be seen in FIG. 5. The motor 22 is supported on a motor mounting platform 24 and clamped to the platform 24 by an upper 26 and a lower retaining ring 28. The platform rests on two platform supporting posts 30 and held loosely on the supports 30 by a retaining clip 32, which caps a dowell-type extension 33. The dowell 33 goes through the motor mounting platform 24. The platform 24 being adaptable to vibrate in an up and down motion as indicated by the movement arrow 34.

As seen in FIG. 1, the ball 13, upon entering the opening 12A, will drop into the interior of the housing 2, as seen in FIG. 2. The ball 13 will land on a ball guiding channel 36A, the channel 36A being raised above the base of the housing 2 and sloping back towards the shooter's position 6A. The ball rolls down the channel 36A, and onto an unsupported extension portion 38A of the motor mounting platform 24. The ball 13 rolls down the extension portion 38A, it is guided by side walls 40A. so that it comes to rest at the end of portion 38A against the ball stop end wall 43A of portion 38A.

As shown in FIG. 3 and FIG. 4, the weight of the ball 13 on the unsupported portion 38A of the motor mounting platform 24 causes portion 38A to move from its unweighted position, as represented by the broken lines 19A to its downward position as shown. An electric switch 47A consisting of a movable contact 42A mounted on the underside of the unsupported portion 38A, is pressed down against a stationary electricl contact 46A, which is mounted on the base of the housing 2, thereby closing switch 47A.

Figure 11:
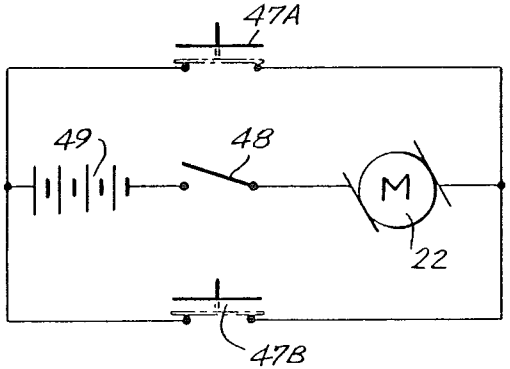
FIG. 11 is a wiring schematic of the electrical system used in the invention.

As can be seen in both the pictorial of FIG. 2 and in the schematic wiring diagram of FIG. 11, two batteries in series 49 are connected through an on-off switch 48, to one side of the motor 22. The other side of the motor 22 is connected by a flexible wire 50A to the movable contact 42A. When the on-off switch 48 is in the "on" position, the presence of the ball 13 on the unsupported portion 38A of the motor mounting platform 24 will energize the motor 22 through wiring 45 and cause the multi-disk assembly 18 to rotate.

As can be seen in FIG. 5, the motor shaft 52 drives the multi-disk assembly 18. The assembly 18 consists of a stepped cylinder collar 54 and two disks 60 and 62, and a pointer 64. The collar 54 is force-fitted onto the motor shaft 52 and rotates with the shaft 52. The stepped collar 54 consists of a larger diameter lower cylinder 56 and a smaller diameter upper cylinder 58. A larger diameter lower disk 62 fits loosely over the upper cylinder 58 and rests on the surface of the lower cylinder 56. The upper smaller disk 60 fits loosely over the motor shaft 52, and rests on the surface of upper cylinder 58.

Both disks 60 and 62 receive a sliding frictional rotational force imparted to them from the spinning of the stepped collar 54. The topmost portion of the motor shaft 52 is capped with a pointer 64, which is rigidly attached to the shaft 52 and rotates with the shaft 52. The pointer 64, acting as a reference indicator, also acts to prevent disk 60 and disk 62 from coming up and off the motor shaft 52.

As shown in FIG. 2, the larger lower disk 62 has a portion on its periphery identified as a "wild card" 65. The upper smaller disk 60 is divided into four sectors: 67, 69, 71, 73, each of these sectors having a symbol inscribed thereon, sector 67 being identified with the letter P, 69 with the letter K, 71 with the letter E, and 73 with the letter E.

As shown in FIG. 3, FIG. 4 and FIG. 5, when the motor 22 is activated, the vibrations induced into the motor mounting platform 24 by the rotation of the motor 22 and the disk assembly 18 is transmitted down the movable portion 38A of the platform 24 and causes the portion 38A to move in a vertical up and down motion, as indicated by the motion arrow 34. The vibrational motion is transmitted to the ball 13 and causes the ball 13 to be shaken off the movable portion 38A through an opening 93A between the side wall 40A and the ball stop wall 43A.

The width of the unsupported portion 38A by the opening 93A is reduced by cutout 41A. This reduced width is a design feature that determines the time duration that the ball 13 remains on the portion 38A before being shaken off, and thereby determines the motor 22 activation time. Once the weight of the ball 13 is off the movable portion 38A, the portion 38A moves upward to its unconstrained position, breaking the motor 22 electrical circuit. The disks 60 and 62 coast to a stop. One of the sectors 67, 69, 71, 73 being in an unpredictable alignment with pointer 64, the pointer 64 may or may not be also pointing to the larger lower disk "wild card" 65 sector.

In one play version, the object is for the player to shoot for the target openings 12A consecutively without missing, so that the pointer eventually designates each sector on disk 62, spelling out the word, "KEEP." Should this pointer 64 point to the outer disk 60 "wild card" 65 sector, any letter needed is considered designated.

DESCRIPTION OF THE ALTERNATE EMBODIMENT

Like-parts or parts having similar functions will have the same numeral designation as in the first embodiment.

Figure 6:
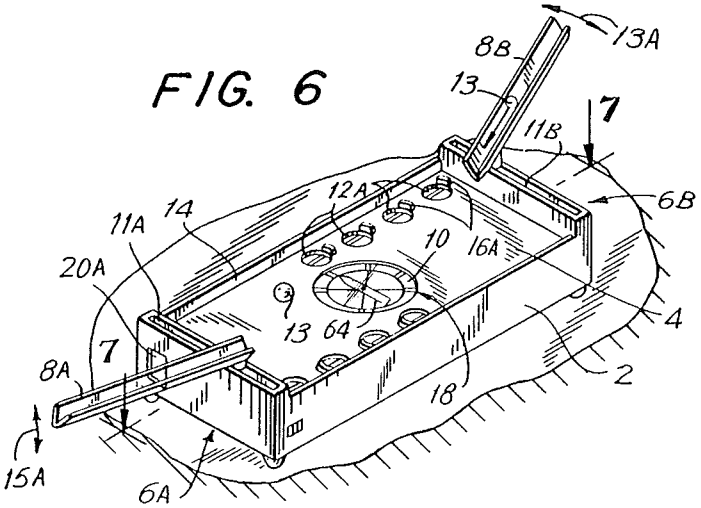
FIG. 6 is a perspective view of an alternate embodiment of my game.

As shown in FIG. 6, in an elongated generally rectangular shaped housing assembly 2, the top surface 4 is the game's playing surface. The game has two playing positions 6A–6B on opposite ends of the game surface 4.

The game apparatus can be considered to consist of two sets of congruent parts, one set being associated with one player's position 6A, and the other with player's position 6B. All designations of the parts of the apparatus in the drawings that apply to one player's position or the other are subscribed with the letter "A" or "B." All parts that are common to both players' positions have only a numeral designation. In general, the description of the invention is as seen from playing position 6A; any reference to a part with the letter "A" subscript also refers to the complementary "B" subscripted part. A description of the game as seen from playing position 6B is identical.

Figure 10:
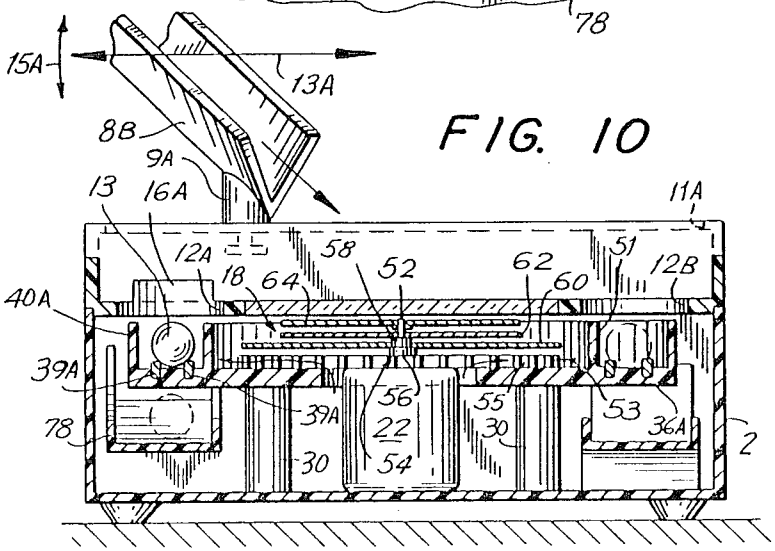
FIG. 10 is a partial cross-sectional view taken generally along the lines 10—10 of FIG. 7.

An aimable marble propelling chute 8A is mounted at playing position 6A. The chute 8A mounting mechanism 9A, as seen in FIG. 6 and FIG. 10, rides in slot 11A and is free to swivel horizontally as shown in FIG. 6 and FIG. 10 motion arrow 13A, and to elevate as shown in motion arrow 15A. The game surface 4 has a transparent window 10 centrally located on the playing surface 4. A set of openings 12A allow entry of a metal marble sized ball 13 into the interior of the housing 2. A ball retaining wall 14 projecting above the surface 4 and around the periphery keeps the ball from going over the edge of the playing surface 4. Each opening 12A has a ball bounce back upright 16A to make it easier for the player to place the ball into the opening 12A. A multi-disk assembly 18 is located beneath the transparent window 10.

A ball 13 entering one of the openings of opening set 12A causes the multi-disk assembly 18 to spin, the ball exits out of the housing 2 at the shooter's position 6A from a ball exit opening 20A. The multi-disk assembly stops spinning in random alignment with a pointer 64, which is part of the multi-disk assembly 18. FIG. 10 indicates that the interior of the housing 2 is equipped with a DC motor 22. The motor 22 is mounted on the base of the assembly 2.

Figure 8:
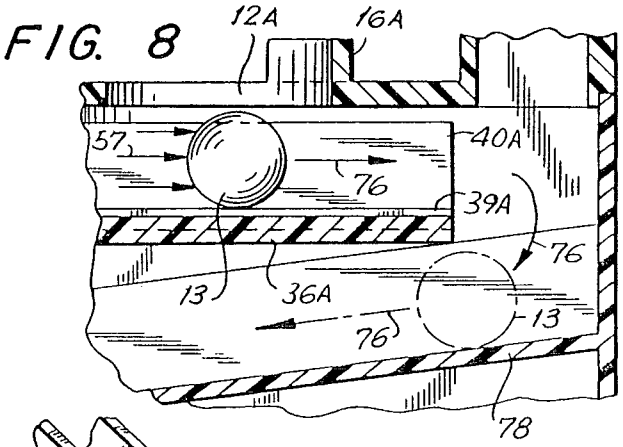
FIG. 8 is a partial cross-sectional view taken generally along the lines 8—8 of FIG. 7.
Figure 7:
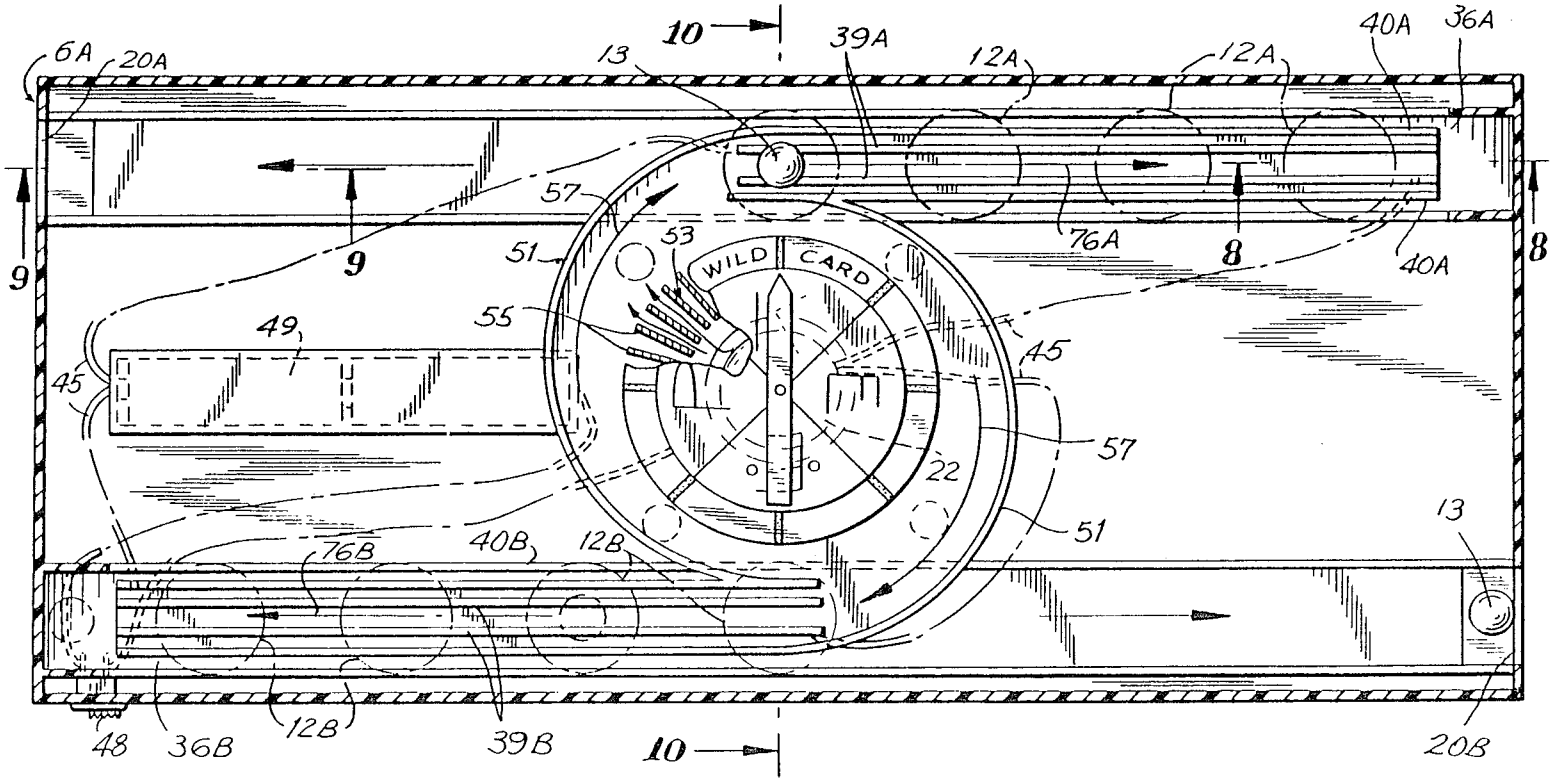
FIG. 7 is a horizontal cross-sectional view taken generally along the lines 7—7 of FIG. 6.

As shown in FIG. 7 and FIG. 8, the metal ball 13 upon entering the opening of set 12A, will drop on a horizontal zero slope ball support channel 36A. The channel 36A is raised above the base of the housing 2 by channel posts 30. The channel 36A has side walls 40A, which serve to keep the ball in the channel 36A.

Two conductive rails 39A, run the length of the channel floor and are adapted to be bridged by the metal conducting ball 13. The presence of the metal ball 13 on both rails acts as a switch, which is represented on the schematic drawing in FIG. 11 as switch 47A. As can be seen in both the pictorial of FIG. 7 and the schematic wiring diagram of FIG. 11, two batteries in series 49 are connected to an on-off switch 48 to one side of the motor 22. The other side of the motor 22 is connected to one of the conducting rails 39A. When the on-off switch 48 is in the "on" position and the conducting ball 13 is resting on both rails 39A, an electrical circuit from the battery 49 to the electric motor 22 is completed through wiring 45 and the motor 22 will rotate.

As can be seen in FIG. 10, the motor shaft 52 drives a stepped cylindrical collar assembly 54. The collar 54 is force-fitted onto the motor shaft 52 and rotates with the shaft 52, the stepped collar 54 consists of an air impeller 53, which is equipped with air vanes 55, a larger diameter lower cylinder 56 and a smaller upper cylinder 58. A larger diameter lower disk 60, having an axial opening that fits over the upper cylinder 58 and rests on the surface of the lower cylinder 56. The upper smaller diameter disk 62 having an axial opening that fits loosely over the motor shaft 52 and rests on the surface of the upper cylinder 58. Both disks 60 and 62 rest on the stepped collar 54 cylinder surfaces and receive a sliding frictional rotational force imparted to them, when the motor shaft 52 causes the stepped collar 54 to spin. The topmost portion of the motor shaft 52 is capped with a pointer 64, which is rigidly attached to the motor shaft 52 and rotates with the shaft, the pointer 64 acting as a reference indice and also acting to prevent disks 60 and 62 from coming up and off the motor shaft 52.

As shown in FIG. 7, as the impeller 53 spins and air flow force arrow 57 is channeled by baffle 51 along the ball support channel 36A, the conductive ball 13 initially is stationary on the zero slope conducting rails 39A, but as the impeller speed increases, the ball 13 moves as indicated by arrows 76 and drops off the ball support channel 36A at the far end, player's position 6B. The baffle 51 dimensions and configuration acting to determine the time duration that the ball remains on the ball support channel 36A.

Figure 9:
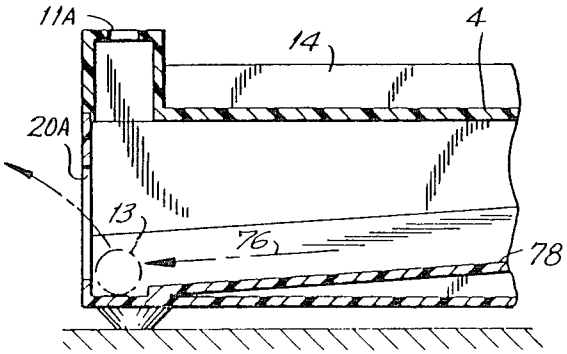
FIG. 9 is a partial cross-sectional view taken generally along the lines 9—9 of FIG. 7.

As shown in FIG. 8 and FIG. 9, the ball 13 drops onto a ball return ramp 78, which is sloped so that the ball 13 rolls back towards the shooter's position 6A and out of the housing through ball exit opening 20A.

Figure 12:
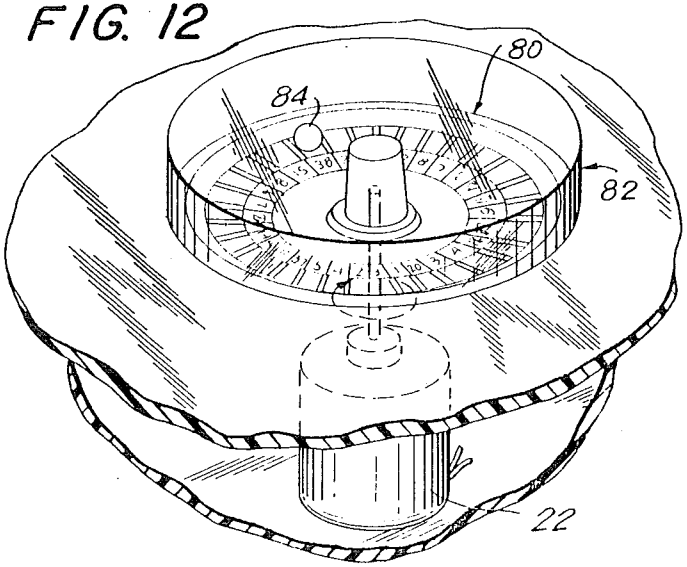
FIG. 12 shows a roulette wheel type of a random symbol generator that can be utilized in the invention.

FIG. 12 shows the motor 22 driving a roulette wheel assembly 80 instead of the multi-disk assembly 18 previously described. The roulette wheel assembly 80 being a closed unit with a transparent cover 82, which acts to prevent the inner roulette wheel ball 84 from escaping the assembly 80.

Figure 13:
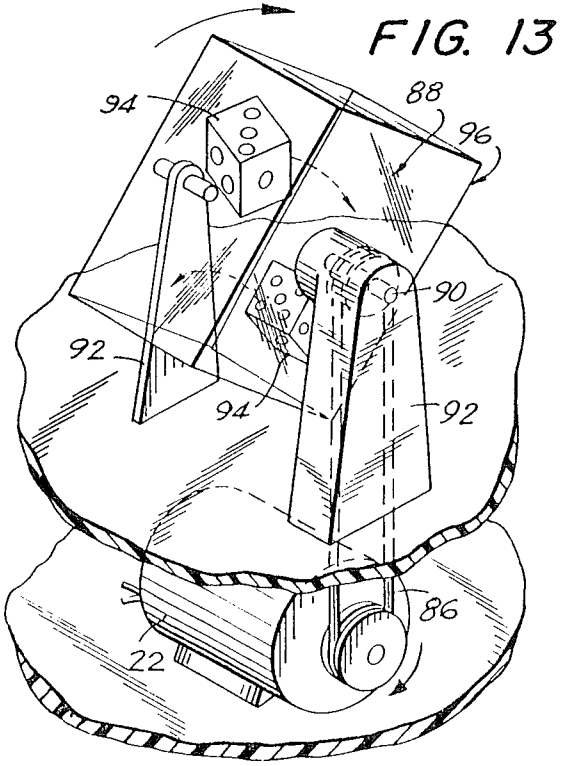
FIG. 13 shows a dice tumbler type of a random symbol generator that can be utilized in the invention.

FIG. 13 shows yet another type of random symbol generator that can be incorporated into the invention. A horizontally mounted motor drives a belt 86, which is coupled to a dice tumbler assembly 88 mounted on an axle 90, which is supported on each end by an axle mounting bracket 92. Two dice 94 are tumbled inside a transparent closed cage 96, that enables the dice to be read out when the tumbler assembly 88 is at rest.

MULTIPLICATION LEARNING APPLICATION OF THE INVENTION

Figure 14:
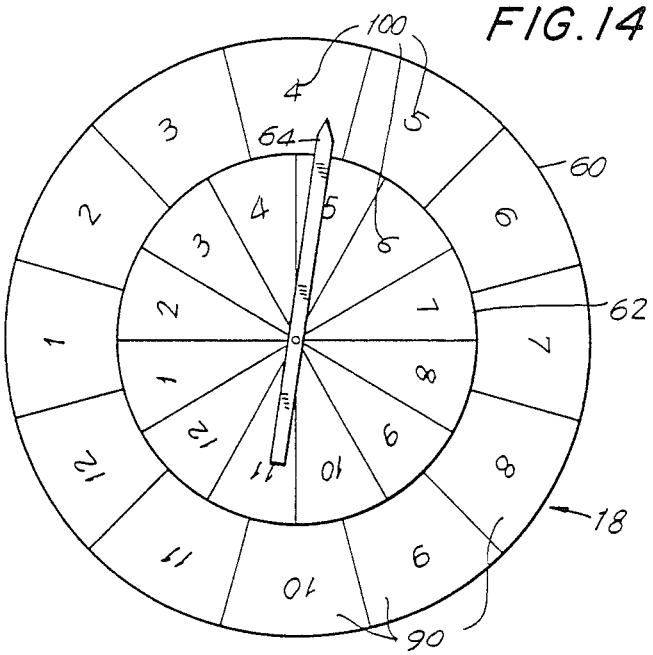
FIG. 14 is a top view of a multi-disk assembly used as a random symbol generator, the division being applicable as a multiplication learning game.

As shown in FIG. 14, the multi-disk assembly 18 inner disk 62 and the outer disk 60 are divided into twelve sectors 90, each sector having a numerical designation one through twelve 100. When a player aims the ball into the target opening, the pointer 64 and the disks 60, 62 will spin. When the assembly 18 comes to a stop, the pointer 64 will designate a value on each disk 60, 62.

Figure 15:
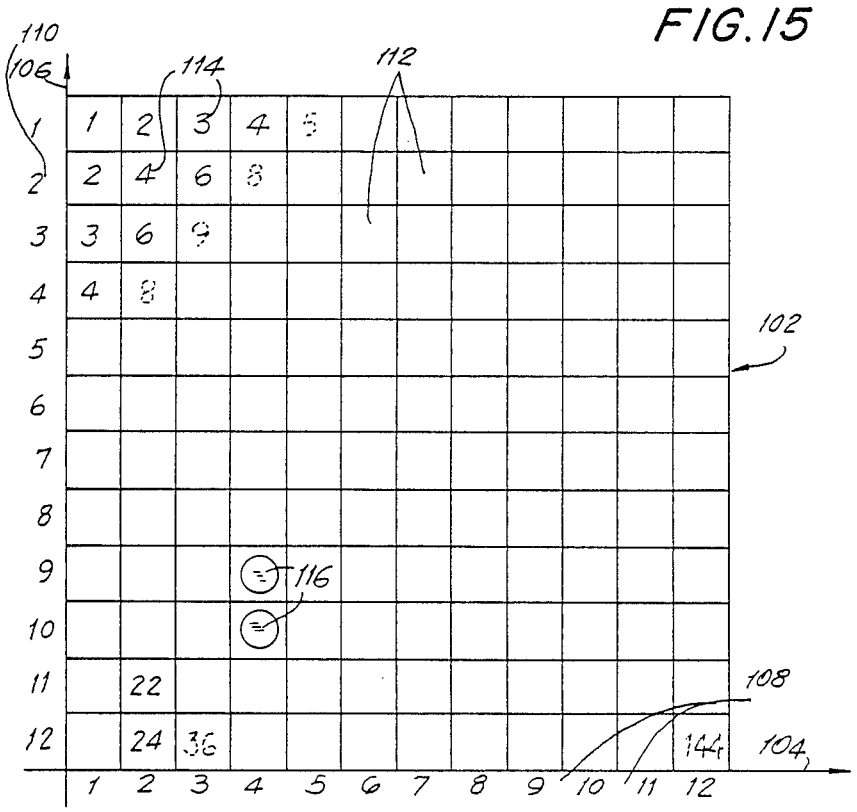
FIG. 15 shows a multiplication matrix board used in conjunction with FIG. 14.

As shown in FIG. 15, the game comes with a multiplication matrix board 102. The board has an X axis 104 and a Y axis 106. The X axis is divided into twelve divisions 108, and the Y axis is divided into twelve divisions 110. The X axis divisions are associated with the twelve values printed on the outer disk 60, while the Y axis divisions are associated with the twelve values printed on the inner disk 62. The multiplication product 114 is printed at the intersection position 112 of the X axis coordinate 108 and the Y axis coordinate 110. The matrix board 102 is adapted to receive a marker chip 116 at the coordinate intersection position 112, said chip 116 representing the product value 114 at the intersection position 112. The outer disk 60 is one color and the inner disk 62 is another color. The corresponding axis on matrix board 102 being the same color as the disk associated with it.

In play, the player would place a marker chip 116 on the coordinate intersection 112 of the matrix board 102 corresponding to the disk readout of the inner disk 62 and the outer disk 60 as indicated by the pointer 64 of the multi-disk assembly 18, the object being to place as many marker chips 16 on the matrix board 102 without having a sum total going over 200. Missing the target opening is an instant loss.

This embodiment is only exemplary. The multiplication matrix board 102 could be replaced with an addition-type matrix board, whereas the coinciding axes positions intersection, corresponding to the sum of the axes values, or the matrix could be designed to be applicable to other functions that are compatible with a coordinate system.

The multi-disk assembly could just as easily be a dice tumbler as shown in FIG. 13, and its application could be widened by using dice with more than six faces, so as to permit more than six numbers to be part of the game play.

While this invention has been shown and described in the best form known, it will nevertheless be understood that this is purely exemplary and that modifications may be made without departing from the scope of the invention as defined in the appended claims. It is also to be understood that various combinations of the alternate embodiments may be interchanged. One example of this interchangeability is that the air vane method of dislodging the ball 13 from the ball support 36A can also be used instead of or in combination with the vibrational action of a vibrational motor mounting platform 24, or vice-versa.

I claim:

1.

(i) An game apparatus comprising of a housing structure, said structure having an outside surface, said surface having at least one entry opening, said opening being adaptable to afford passage of a ball into the interior of the housing.

(ii) At least one ball support member, said ball support member being adapted to receive said ball as a result of said ball entering said entry opening, said ball support being so constructed that said ball being deposited on said ball support will be contained thereon, until it is dislodged from said support (iii) An electric motor (iv) A rotor device, said rotor device being coupled to said motor, and to rotate when said motor is activated (v) A source of electrical current (vi) An electrical wiring connecting said current source to an electrical contact means, said contact means being adaptable to connect said current feed to said electrical motor by the presence of said ball on said ball support and said contact means being adapted to open said current feed to said electrical motor, in the absence of said ball on said ball support, said ball support being so constructed, that said ball being deposited on said ball support, will remain thereon for a period of time, sufficient for said current feed to said motor to cause said motor to reach a speed of rotation, and means responsive to said speed of rotation for dislodging said ball from said ball support, thereby opening said current feed.

2. An apparatus as claimed in claim 1, wherein said ball support being so constructed that said ball being deposited on said ball support will be contained thereon for a period of time, that will cause said electrical circuit to be completed for over one second and less than sixty seconds.

3. An apparatus as claimed in claim 1, wherein said rotor device in conjunction with said motor rotation provides the means to cause said ball to become dislodged from said ball support.

4. An apparatus as claimed in claim 1, wherein said motor-rotor rotation generates an airflow force, said force providing the means to dislodge said ball off said ball support.

5. An apparatus as claimed in claim 1, wherein said motor-rotor rotation generates vibrational tremors in said ball support member, said tremors providing the means to dislodge said ball off said ball support.

6. An apparatus as claimed in claim 1, wherein said motor-rotor rotation generates vibrational tremors in said ball support member, said tremors providing the means to dislodge said ball off said ball support, wherein said motor is mounted on a motor mounting platform, said platform resting on and held captive to a platform support means, said platform support means being adapted to allow said motor mounting platform to vibrate in sympathy with said motor, said rotor rotation, and said platform transmitting said vibrations to said ball support and to said ball, said vibrations acting to dislodge said ball from said ball support.

7. An apparatus as claimed in claim 1, wherein said motor-rotor rotation causing at least one disk to spin, said disk having angular sector portions marked thereon, each sector having a symbolic designation associated with it, an indicating means, said indicating means designating an alignment with one angular sector portion, when said disk has stopped spinning.

8. An apparatus as claimed in claim 1, wherein said motor-rotor rotation causes a plurality of disks to spin, said disks being marked off in sectors, each sector having a symbolic designation associated with it, an indicating disk, said indicating disk having an indicating means, said indicating means designating said sectors symbolic markings that are in alignment when said disks cease spinning.

9. An apparatus as claimed in claim 1, wherein said motor, rotation causes a dice tumbler device to shake and tumble a dice set, so that the dice read out when the tumbler ceases tumbling and is stationary, is unforecastable.

10. An apparatus as claimed in claim 1, wherein said motor rotor rotation causes a roulette wheel assembly to spin, said roulette value read out, being unforecastable when roulette wheel assembly ceases to spin.

11. An apparatus as claimed in claim 1, wherein said ball support means includes an elongated strip, said strip being mounted onto a raised support means, said strip having an extended portion, said extended portion, being movable with respect to said raised support means, said movable portion carrying one of a pair of cooperating electrical contacts, arranged in said current feed circuit, said movable portion of said strip having an unconstrained rest condition, in said rest condition said electrical contacts are open, said movable portion of said strip being adapted to receive said ball, the weight of said ball, causing said movable portion of said strip to move to its downward position, in said downward position, said electrical contacts are closed, thereby completing the electrical current source circuit to said motor, and after said ball is off of said strip, said strip is restored to its unconstrained rest position, opening said electrical contacts, thereby breaking the current source to said motor.

12. An apparatus as claimed in claim 1, wherein said ball support means includes an elongated strip, said strip being mounted onto a raised support means, said strip having an extended portion, said extended portion being movable with respect to said raised support means, said movable portion carrying one of a pair of co-operating electrical contacts, arranged in said current feed circuit, said movable portion of said strip having an unconstrained rest condition, in said rest condition said electrical contacts are open, said movable portion of said strip being adapted to receive said ball, the weight of said ball, causing said movable portion of said strip to move to its downward position, in said downward position, said electrical contacts are closed, thereby completing the electrical current source circuit to said motor, and after said ball is off of said strip, said strip is restored to its unconstrained rest position, opening said electrical contacts, thereby breaking the current source to said motor, said ball support means being equipped with containing walls, said walls having a ball egress opening, said walls acting to keep said ball on said strip, until said ball is forced through said egress opening and off said strip, said force being a result of said motor, said rotor rotation,

13. An apparatus as claimed in claim 1, wherein said ball support consists of a pair of spaced adjacent electrical conductor rails, said conductive rails being adapted upon receiving an electrically conductive metal ball, to bridge said current feed circuit to said electric motor, and to open said current feed circuit, in the absence of said electrically conductive ball.

14. An apparatus as claimed in claim 1, wherein said ball support consists of a pair of spaced adjacent electrical conductor rails, said conductive rails being adapted upon receiving an electrically conductive metal ball, to bridge said current feed circuit to said electric motor, and to open said current feed circuit, in the absence of said electrically conductive ball, said conductive rails being so configured that a ball being deposited on said rails will remain thereon until being acted upon by an external force, said force being a result of said motor, said rotor rotation.

15. An apparatus as claimed in claim 1, wherein said rotor device consists of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk axial opening diameter being such, that each disk when assembled on said collar, will rest on a specific horizontal cylinder surface and no other, each disk being rotational about the vertical cylinder walls, which acts as a free wheeling axel means, each disk being raised above the disk beneath it, by the height of the cylinder step, said rotor device topmost portion being equipped with a disk retaining means, said retaining means acting to prevent said disks from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said markings on each disk being in random alignment with each other.

16. An apparatus as claimed in claim 1, wherein said rotor device consists of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk axial opening diameter being such, that each disk, when assembled on said collar, will rest on a specific horizontal cylinder surface and no other, each disk being rotational about the vertical cylinder walls, which acts as a free wheeling axle means, each disk being raised above the disk beneath it, by the height of the cylinder step, said driveshaft topmost portion being equipped with a disk retaining means, said retaining means acting to prevent said disk from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said marking on each disk being in random alignment with each other, said disk retaining means carrying an index pointer, said pointer being fixed to topmost portion of said motor drive shaft, and rotating with said shaft, said pointer being adapted to designate said disk markings in alignment with each other.

17. An apparatus as claimed in claim 1, wherein said rotor device consists of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk axial opening diameter being such, that each disk when assembled on said collar, will rest on a specific horizontal cylinder surface and no other, each disk being rotational about the vertical cylinder walls, which acts as a free wheeling axel means, each disk being raised above the disk beneath it, by the height of the cylinder step, said drive shaft topmost portion being equipped with a disk retaining means, said retaining means acting to prevent said disk from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said markings on each disk being in random alignment with each other, said disk being of successive decreasing diameters, the disk with the largest diameter being the lowermost and the disk with the smallest diameter being the uppermost, and means for said angular spaced markings to be visible when said disks coast to a stop.

18. An apparatus as claimed in claim 1, wherein said rotor device consists of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk axial opening diameter being such, that each disk, when assembled on said collar, will rest on a specific horizontal cylinder surface and no other, each disk being rotational about the vertical cylinder walls, which acts as a free wheeling axel means, each disk being raised above the disk beneath it, by the height of the cylinder step, said driveshaft topmost portion being equipped with a disk retaining means, said retaining means acting to prevent said disk from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said markings on each disk being in random alignment with each other, said lowermost cylinder being equipped with air vanes, said air vanes being adapted to create an airflow force, when said stepped collar is rotating, said force being adapted to dislodge said ball from said ball support.

19. An apparatus as claimed in claim 1, wherein said housing structure has a generally rectangular top outside playing surface, said playing surface having a player's playing position at each far end, each playing position being equipped with a ball propelling means, said playing surface having two sets of ball entry openings, each set of said openings being associated as a target opening for one of the ball propelling means, each set of entry openings affording passage to said ball into the interior of said housing, and onto said ball support, said housing interior being equipped with two ball support being associated with one set of entry openings, said apparatus having two ball exist openings, each exit opening being associated with one set of entry openings, said exit openings allowing passage of said ball to exist from said housing interior, said top playing surface having side walls, to prevent said ball from rolling off of said playing surface.

20. An apparatus as claimed in claim 1, wherein said ball support construction, in conjunction with said rotor device rotation, determines the time duration that the ball remains on the ball support.

21. An apparatus as claimed in claim 1, wherein the motor driven device is adapted to provide a designation of at least two numerical values when the device is at rest, each value being one of a set, these numerical values to be acted upon when the motor driven device is being spun, so that the readout of the values when the device is at rest is unpredictable, a coordinate board having at least two axes, each axis being associated with one set of said numerical values, each axis being divided into divisions, each division representing one value of said set, and establishing a coordinate position associated with each numerical value of said set, the coordinate board having the means to indicate the result of an arithmetic function of the two numerical values on the axes, the result of the arithmetic function being indicated at the position of the intersection of the two coordinates.

22. An apparatus as claimed in claim 1, wherein said housing structure top playing surface has a plurality of entry openings, said entry openings affording passage to said ball into the interior of said housing and onto said ball support.

23. An apparatus as claimed in claim 1, wherein said apparatus is equipped with a ball propelling means, said ball propelling means being adapted to cause a ball to travel to and to enter said entry opening.

24. An apparatus as claimed in claim 1, wherein said apparatus is equipped with a ball propelling means, said ball propelling means being adapted to cause a ball to travel to and to enter said entry opening, wherein said ball propelling means is adapted to be aimable, enabling a player to aim said ball propelling means, so that if said propelling means is aimed correctly said ball will enter said entry

25. An apparatus as claimed in claim 1, wherein said apparatus is equipped with a ball propelling means, said ball propelling means being adapted to cause a ball to travel to and to enter said entry opening, said ball propelling means being in the shape of a cannon.

26. An apparatus as claimed in claim 1, wherein said apparatus is equipped with a ball propelling means, said ball propelling means being adapted to cause a ball to travel to and to enter said entry opening, said ball propelling means being a downward sloping ball chute.

27. An apparatus as claimed in claim 1, wherein said entry opening is equipped with a ball rebound means, said rebound means being adapted to allow a ball that has overshot said opening to bounce back into said opening.

28. An apparatus as claimed in claim 1, wherein said outside surface is equipped with a transparent window portion, said window portion providing the means for observing said disk readout values.

29. A game apparatus having the means of completing an electrical circuit to a motor, said motor upon activation, causing a rotor device to spin, said rotor consisting of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk when assembled on said collar, will rest on a specific horizontal cylinder surface and no other, each disk being rotational about the vertical cylinder walls, which acts as a free wheeling axle means, each disk being raised above the disk beneath it, by the height of the cylinder step, said drive shaft topmost portion being equipped with a disk retaining means, said retaining means acting to prevent said disk from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said markings on each disk being in random alignment with each other, said apparatus being equipped with a means of designating said markings on each disk in alignment with each other.

30. A game apparatus device consisting of (i) An electric motor (ii) A rotor device, said rotor device being coupled to said motor, and to rotate when said motor is activated (iii) A source of electrical current (iv) An electrical wiring connecting said current source to an electrical contact means, said contact means being adapted to connect said current feed to said electrical motor, said contact means being adapted to open said current feed to said electrical motor, said rotor device consisting of a stepped drive shaft collar, said stepped collar consisting of cylinders of successively decreasing diameters, the cylinder with the largest diameter being the lowermost, and the cylinder with the smallest diameter being the uppermost, said cylinders having a common axis and being rigidly coupled to the motor drive shaft, said collar being adapted to receive a number of disks according to the number of stepped cylindrical portions on said collar, said disks being arranged one above the other, each disk having an axial circular opening of successively decreasing diameters, the disk with the largest axial opening being the lowermost and the disk with the smallest axial being the uppermost, each disk axial opening diameter being such, that each disk when assembled on said collar, will rest on a specific horizontal cylinder surface and no other, each disk being rotational about the vertical cylinder walls, which acts as a free wheeling axle means, each disk being raised above the disk beneath it, by the height of the cylinder step, said rotor device topmost portion being equipped with a disk retaining means, said retaining means acting to prevent said disk from coming off of said collar, said disks having angular spaced markings imprinted thereon, when said motor causes said collar to spin, said disks receive a frictionally slipping rotation force imparted to them by the rotation of said collar and upon the deactivation of said motor, said disks coast to a stopped position, said markings on each disk being in random alignment with each other, said disks being of successive decreasing diameters, the disk with the largest diameter being the lowermost and the disk with the smallest diameter being the uppermost, said angular spaced markings being printed on the peripheral portion of said disk surfaces, said markings on said disk surfaces being visible, said apparatus being equipped with a means of designating said markings on each disk in alignment with each other.

31. An apparatus as claimed in claim 29 wherein said markings on said disks being numerical values, said numerical values providing two unpredictable number values when the device comes to rest, each numerical value being one of a set, a coordinate board having at least two axes, each axis being associated with one set of said numerical values, each axis being divided into divisions, each division representing one value of said set, and establishing a coordinate position associated with each numerical value of said set, the coordinate board having the means to indicate the result of an arithmetic function of the two numerical values on the axes, the result of the arithmetic function being indicated at the position of the intersection of the two coordinates.

32. An apparatus as claimed in claim 30, wherein said markings on said disks being numerical values, said numerical values providing two unpredictable number values when the device comes to rest, each numerical value being one of a set, a coordinate board having at least two axes, each axis being associated with one set of said numerical values, each axis being divided into divisions, each division representing one value of said set, and establishing a coordinate position associated with each numerical value of said set, the coordinate board having the means to indicate the result of an arithmetic function of the two numerical values on the axes, the result of the arithmetic function being indicated at the position of the intersection of the two coordinates.

33. A game appartus, said game apparatus, having a means of electrically activating and deactivating an electrical motor, said motor upon activation, causing a coupling device to spin, said coupling device imparting a slipping frictional rotational force to a plurality of disks, causing said disks to rotate around a common axle shaft, said disks having angular spaced markings printed thereon, and upon the deactivation of said motor, said disks coast to a random stopped position, said markings stopping in an unforecastable configuration with each other, an index means said index means designating a set of said markings in alignment.

34. A game apparatus, said game apparatus, having a means of electrically activating and deactivating an electrical motor, said motor upon activation, causing a coupling device to spin, said coupling device imparting a slipping frictional rotational force to a plurality of disks, causing said disks to rotate around a common axle shaft, said disks having angular spaced markings printed thereon, and upon the deactivation of said motor, said disks coast to a random stopped position, said markings stopping in an unforecastable configuration with each other, an index means said index means designation a set of said markings in alignment, wherein said markings include at least two sets of numerical values.

35. A game apparatus, said game apparatus, having a means of electrically activating and deactivating an electrical motor, said motor upon activation, causing a coupling device to spin, said coupling device imparting a slipping frictional rotational force to a plurality of disks, causing said disks to rotate around a common axle shaft, said disks having angular spaced markings printed thereon, and upon the deactivation of said motor, said disks coast to a random stopped position, said markings stopping in an unforecastable configuration with each other, an index means said index means designating a set of said markings in alignment, wherein said markings include at least two sets of numerical values, a coordinate axes board, said board having at least two axes, each axis being divided into divisions, each division having marked thereon, a numerical value corresponding to one of said angular spaced numerical values, said coordinate board axes divisions locating an axes coordinate intersection position on said coordinate axes board, said axes coordinate intersection position having marked thereon, the result of an arithmetic function, acting on said coordinate axes division values.

36. A game apparatus, said game apparatus, having a means of electrically activating and deactivating an electrical motor, said motor upon activation, causing a coupling device to spin, said coupling device imparting a slipping frictional rotational force to a plurality of disks causing, said disks to rotate around a common axle shaft, said disks having angular spaced markings printed thereon, and upon the deactivation of said motor, said disks coast to a random stopped position, said markings stopping in an unforecastable configuration with each other, an index means said index means designating a set of said markings in alignment, wherein said markings include at least two sets of numerical values, a coordinate axes board, said board having at least two axes, each axis being divided into divisions, each division having marked there on a numerical value corresponding to one of said angular spaced numerical value, said coordinate board axes divisions locating an axes coordinate intersection position on said coordinate axes board, said axes coordinate intersection position having marked thereon the result of an arithmetic function, acting on said coordinate axes division values, said apparatus including marker pieces, said marker pieces providing the means to mark said axis coordinate intersection position.

37. A game apparatus, said game apparatus, having a means of electrically activating and deactivating an electrical motor, said motor upon activation, causing a coupling device to spin, said coupling device imparting a slipping frictional rotational force to a plurality of disks causing, said disks to rotate, said disks having angular spaced markings printed thereon, and upon the deactivation of said motor, said disks coast to a random stopped position, said markings stopping in an unforecastable configuration with each other, an index means, said index means designating a set of said markings in alignment.

38. A game apparatus, said game apparatus, having a means of electrically activating and deactivating an electrical motor, said motor upon activation, causing a coupling device to spin, said coupling device imparting a slipping frictional rotational force to a plurality of disks, causing said disks to rotate, said disks having angular spaced markings printed thereon, and upon deactivation of said motor, said disks coast to a random stopped position, said markings stopping in unforecastable configuration with each other, an index means said index means designating a set of said markings in alignment, wherein said markings include at least two sets of numerical values.

39. A game apparatus, said game apparatus, having a means of electrically activating and deactivating an electrical motor, said motor upon activation, causing a coupling device to spin, said coupling device imparting a slipping frictional rotational force to a plurality of disks, causing said disks to rotate, said disks having angular spaced markings printed thereon, and upon the deactivation of said motor, said disks coast to a random stopped position, said markings stopping in an unforecastable configuration with each other, an index means said index means designating a set of said markings in alignment, wherein said markings include at least two sets of numerical values, a coordinate axes board, said board having at least two axes, each axis being divided into divisions, each division having marked there on a numerical value corresponding to one of said angular spaced numerical values, said coordinate board axes divisions locating an axes coordinate intersection position on said coordinate axes board, said axes coordinate intersection position having marked thereon the result of an arithmetic function, acting on said coordinate axes division values.

40. A game apparatus, said game apparatus, having a means of electrically activating and deactivating an electrical motor, said motor upon activation, causing a coupling device to spin, said coupling device imparting a slipping frictional rotational force to a plurality of disks, causing said disks to rotate, said disks having angular spaced markings printed thereon, and upon the deactivation of said motor, said disks coast to a random stopped position, said markings stopping in an unforecastable configuration with each other, an index means said index means designating a set of said markings in alignment, wherein said markings include at least two sets of numerical values, a coordinate axes board, said board having at least two axes, each axis being divided into divisions, each division having marked thereon a numerical value corresponding to one of said angular spaced numerical values, said coordinate board axes divisions locating an axes coordinate intersection position on said coordinate axes board, said axes coordinate intersection position having marked thereon the result of an arithmetic function, acting on said coordinate axes division values, said apparatus including marker pieces, said marker pieces, providing the means to mark said axis coordinate intersection position.

* * * * *